US006980131B1

(12) United States Patent
Taylor

(10) Patent No.: US 6,980,131 B1
(45) Date of Patent: Dec. 27, 2005

(54) TARGETED IMPENDING ARRIVAL NOTIFICATION OF A WIRELESSLY CONNECTED LOCATION DEVICE

(75) Inventor: Sean Dominic Taylor, Fremont, CA (US)

(73) Assignee: @Road, Inc., Fremont, CA (US)

( * ) Notice: Subject to any disclaimer, the term of this patent is extended or adjusted under 35 U.S.C. 154(b) by 0 days.

(21) Appl. No.: 09/696,722

(22) Filed: Oct. 24, 2000

(51) Int. Cl.[7] ..... G08G 1/123

(52) U.S. Cl. ..... 340/994; 340/990; 340/995.1; 340/995.17; 340/988; 340/902; 340/905

(58) Field of Search ..... 340/994, 988, 340/905, 441, 444, 439, 990, 995.1, 995.17, 340/902

(56) References Cited

U.S. PATENT DOCUMENTS 5,442,805 A * 8/1995 Sagers et al. ..... 455/33.1
5,444,444 A * 8/1995 Ross ..... 340/994
5,554,982 A * 9/1996 Shirkey et al. ..... 340/903
5,668,543 A * 9/1997 Jones ..... 340/994
5,724,243 A * 3/1998 Westerlage et al. ..... 340/944
5,808,565 A * 9/1998 Matta et al. ..... 340/994
5,959,577 A * 9/1999 Fan et al. ..... 342/357.13
5,983,198 A * 11/1999 Mowery et al. ..... 340/990
5,987,377 A * 11/1999 Westerlage et al. ..... 340/994
6,088,594 A * 7/2000 Kingdon et al. ..... 455/457
6,124,810 A * 9/2000 Segal et al. ..... 340/994

* cited by examiner

*Primary Examiner*—Hung T. Nguyen
(74) *Attorney, Agent, or Firm*—MacPherson Kwok Chen & Heid LLP

(57) ABSTRACT

A rover determines a destination and periodically checks the location of the rover against one or more active alert thresholds. One alert threshold is the boundary of an alert area surrounding a destination. The rover sends an alert to a service center alerts a designated party of an impending arrival of the rover at the destination when the rover is within an alert area surrounding the destination. The service center can also alert a designated party when the rover leaves an alert area surrounding a location. The alerts can be communicated via an automated telephone message, a pager message, an e-mail message, or any other means of communication. The alerts can be used for deliveries by directing an alert to a customer expecting a delivery or to a site expecting a vehicle for loading or unloading. In a private context, the alerts can automatically activate systems such as a home appliances or systems in anticipation of a resident's arrival.

22 Claims, 3 Drawing Sheets

TARGETED IMPENDING ARRIVAL NOTIFICATION OF A WIRELESSLY CONNECTED LOCATION DEVICE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

This invention relates to communications and tracking systems that track the location, movement, and destination of vehicles or individuals.

2. Description of Related Art

Many businesses deliver packages to customers and may have one or a fleet of vehicles for such deliveries. A nearly universal problem for these businesses is tracking and planning the movement of the delivery people and vehicles. FIG. 1 shows a tracking system similar to that described in U.S. Pat. No. 5,959,577, which is hereby incorporated by reference in its entirety. The system of FIG. 1 includes multiple mobile units (also referred to herein as rovers) 110. Each rover 110 can be a handheld device that a delivery person carries or a device mounted in a vehicle. Each rover 110 contains a global positioning system (GPS) receiver, a wireless device, and a control circuit. When activated, the GPS receiver receives signals from GPS satellites 120 and from the signal identifies the position (e.g., longitude and latitude) and velocity of a rover 110. The wireless device, typically a wireless modem, transmits the position and velocity information via a wireless network 130 and the Internet 150 to a service center 140.

Service center 140 receives and collects data from mobile units 110 and makes the collected data available to a user of a terminal 160. Terminal 160 is typically a computer that connects via the Internet 150 to a web site associated with service center 140. The user can view the data or send a query or message to service center 140 for relaying to a specific rover 110. In response to communications from terminal 160, service center 140 sends the query or message to the selected rover 110.

Although the system of FIG. 1 provides a convenient method for a business to track deliveries, the system is generally not accessible to the business' customers who may also be interested in knowing when a delivery will arrive. Additionally, the business expecting an arrival of a vehicle at a particular location such as a loading dock must periodically check the position of the vehicle to determine when the vehicle can be expected. This monitoring may be subject to errors since the vehicle while near the destination may be headed elsewhere. Accordingly, a possible improvement of the system of FIG. 1 would be to provide better information indicating expected arrival times and to provide such information not only to the business but also to customers without requiring the business or customers to constantly poll the position of the delivery vehicle.

SUMMARY

In accordance with an aspect of the invention, a rover identifies a destination or travel threshold, periodically checks the rover's location relative to the destination or threshold, and sends an alert to a service center upon nearing the destination or crossing the threshold. The service center relays the alert to one or more designated party. Accordingly, the service center can alert a designated party when the rover nears a destination or when the rover leaves an alert area surrounding a location. The alerts can be relayed via an automated telephone message, a pager message, an e-mail message, or any other communication means. The alerts can be used for deliveries by directing an alert to a customer expecting a delivery or to a site expecting a vehicle for loading or unloading. In a private context, the alerts can automatically activate systems such as a home appliances or systems in anticipation of a resident's arrival.

One embodiment of the invention is an alert generating method. The alert generating method includes: providing to a mobile unit information that identifies conditions for an alert; monitoring by the mobile unit, of the position of the mobile unit; and alerting a designated location when the monitoring indicates the mobile units satisfies the conditions for the alert. The conditions for an alert typically include that the mobile unit is headed to a specific destination and is within an alert area surrounding that destination or the mobile unit has entered or left an alert area. Typically, alerting the designated location includes: sending a signal from the mobile unit to a service center when the mobile unit satisfies the conditions for the alert; and generating the alert from the service center to the designated location in response to the signal from the mobile unit. The alert can be sent to a telephone, a pager, or an e-mail address.

Another embodiment of the invention is a delivery method that includes creating a list of destinations for deliveries. The list includes a threshold distance and other information for one or more destination for which an alert should be generated. A next destination that a delivery vehicle is headed towards is selected from the list for the delivery vehicle, and the delivery vehicle monitors distance between the delivery vehicle and the selected destination. The delivery vehicle generates an alert when the distance is less than a threshold distance associated with the destination. More specifically, generating the alert includes sending a message from the delivery vehicle to a service center, looking-up a designated location that corresponds to the destination, and sending the alert from the service center to the designated location.

Yet another embodiment of the invention is a mobile unit that includes a location system, a wireless device, and a control circuit. In one mode, the control system periodically activates the location system to determine a current location of the mobile unit, determines whether the mobile unit has satisfied an alert condition (e.g., has entered or left an alert area), and activates the wireless device to send an alert signal if the mobile unit has satisfied the alert condition. The location system is typically a GPS receiver, and the wireless device is typically a wireless modem or telephone. The control circuit can determine whether the current location is within the alert area by determining whether a distance between the current location and a central point or destination in the alert area is less than or greater than a threshold distance associated with the alert area.

Still another embodiment of the invention is a system including a communication connection, an alerting device, and a service center. The communication connection allows the service center to receive messages from a mobile unit, and the alerting device allows the service center to send alerts. Generally, the service center maintains contact information for the mobile unit, and in response to a signal from the mobile unit, the service center activates the alerting device to send an alert to a designated location identified in the contact information. The contact information can be kept at the service center or forwarded from the mobile unit to the service center. The service center is generally Internet accessible to allow multiple, geographically disparate people to set the conditions for an alert and the designated location to which the alerting device sends the alert.

BRIEF DESCRIPTION OF THE DRAWINGS

Use of the same reference symbols in different figures indicates similar or identical items.

DETAILED DESCRIPTION

Figure 1:
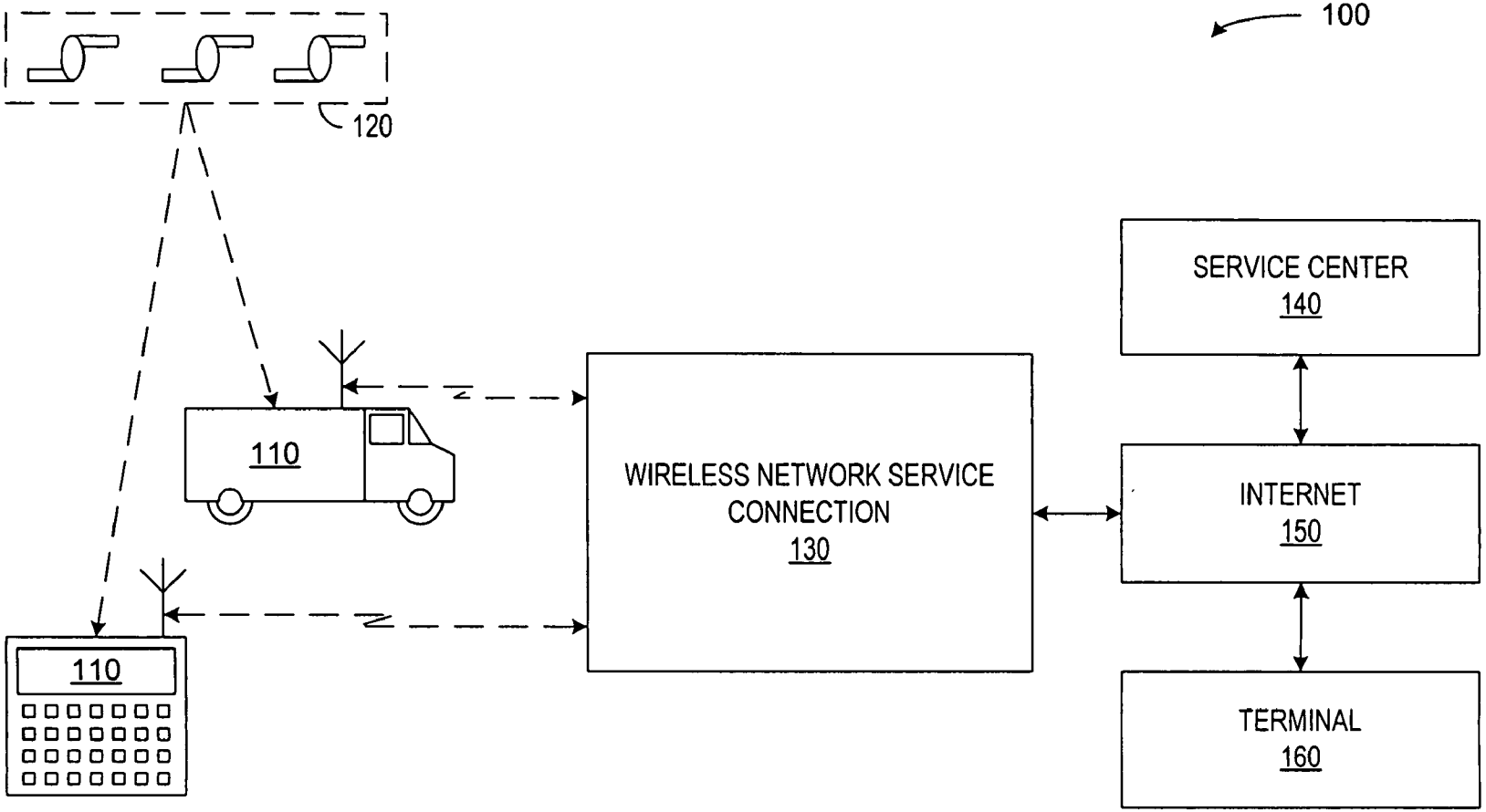
FIG. 1 shows a block diagram of a tracking system.
Figure 2:
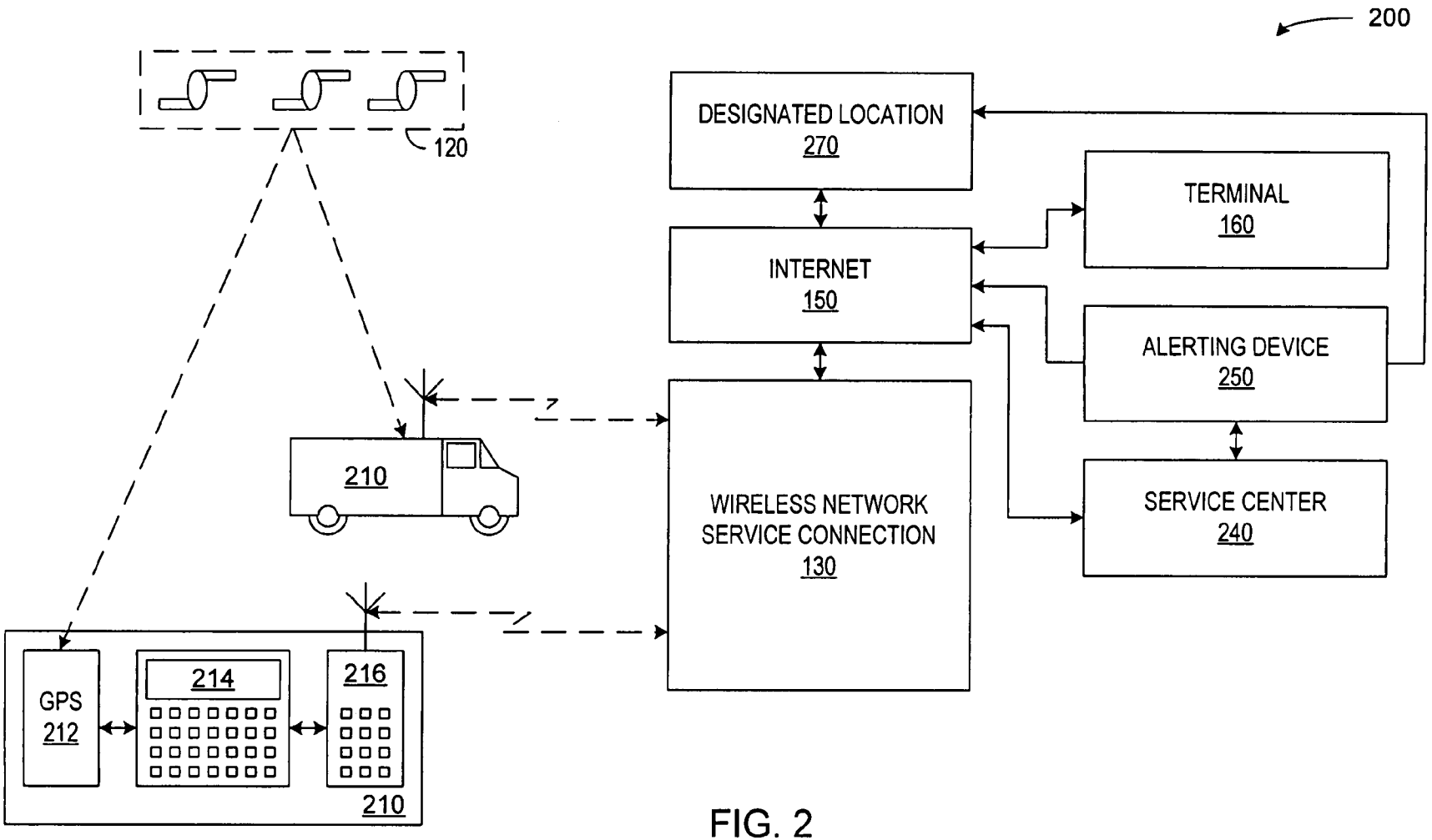
FIG. 2 shows a tracking and impending arrival notification system in accordance with an embodiment of the invention.

In accordance with an aspect of the invention, a tracking system automatically alerts a designated party before a mobile unit (or rover) arrives at a destination. FIG. 2 illustrates a system 200 implementing alerts in accordance with the invention. System 200 is similar to system 100 described above and includes rovers 210, GPS satellites 120, a wireless network service connection 130, a service center 240, an alerting device 250, the Internet 150, and terminal 160. Rovers 210 and service center 240 of FIG. 2 are similar to rovers 110 and service center 140 of FIG. 1. In particular, service center 240 communicates with and tracks multiple rovers 210, as describe above. However, rovers 210 and service center 240 have additional features for generating impending arrival alerts to designated locations 270. These additional features can be implemented in software or firmware performing the functions described further below.

Each rover 210 includes a communications package such as the iLM 2000 available from @Road, Inc. The communications package includes a GPS receiver 212, a control circuit 214, and a wireless device 216. GPS receiver 212 when activated interprets signals from GPS satellites 120 to identify the position and velocity of the rover 110. Control circuit 214 has a user interface including a keyboard or other input device for operator control of the communications package, a display or another output device for conveying information such as the status of the package and received messages, and a processing circuit. The processing circuit implements automated operation and commands from the operator or from service center 240.

Wireless device 216 and service connection 130 handle communications between service center 240 and rovers 210. Connection 130 can be any wireless service, whether analogue or digital, which supports data transfers between service center 240 and rover 210. For example, the communication can operate through a CDPD, AMPS, CDMA, GSM, or Nextel system, using both OEM modem modules internal to the rover or cellular phones that are separable from the rover and attached to the remainder of the communication package via a data cable. Although the communications package could use a removable or separate cellular telephone, this is not the ideal solution since removing the telephone disables the connection between the communications package and service center 240. The wireless service 132 preferably offers packetized data and direct connection to the Internet because these capabilities facilitate sporadic data transfers between rovers 210 and service center 240 with least use of the wireless resources and therefore the least cost to the operator of the communications package.

Figure 3:
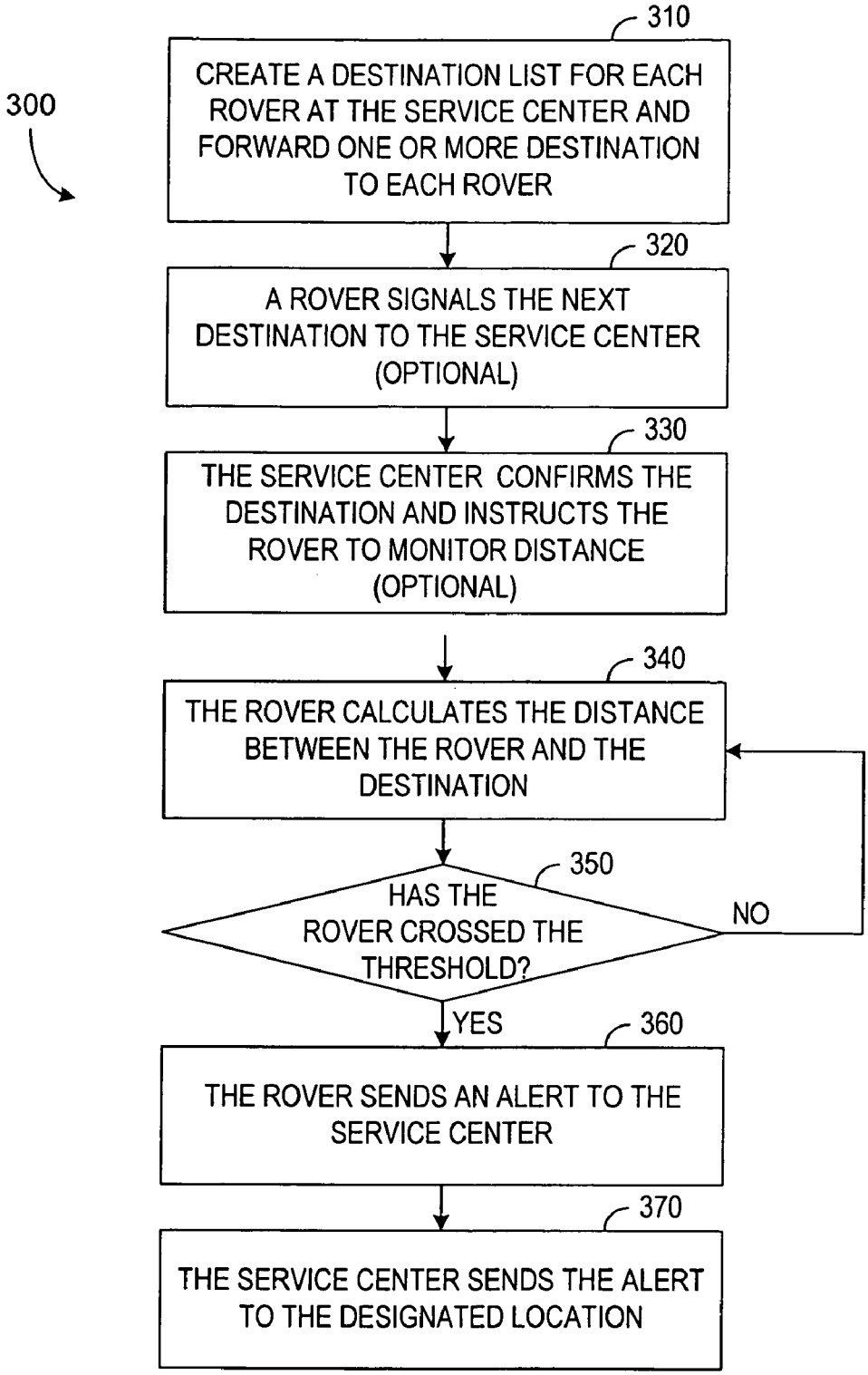
FIG. 3 is a flow diagram of a process for generating an alert in accordance with an embodiment of the invention.

FIG. 3 is a flow diagram of a method 300 of generating impending arrival alerts in accordance with an embodiment of the invention. An initial step 310 of method 300 is creation of a destination list that can be forwarded or downloaded to service center 240 and/or rover 210. Each rover 210 has a destination list, which contains a set of destination entries corresponding to the intended destinations of the rover 210. (The Appendix contains a C-language data structure for one embodiment of a destination list.) Each destination entry includes a location (e.g., an address or longitude and latitude of a destination), an alert condition, contact information for the alert or alerts, and any other information related to the destination, the alert, or the contact. Service center 240 can easily convert an address provided in a destination list to longitude and latitude values, which are commonly used in GPS systems. The alert condition typically includes threshold information, which is typically a distance or radius that defines an alert area around the destination. The alert condition may additionally include fields indicating circumstances for the alert. Typical circumstances surrounding an alert include whether the alert should be sent at all, a direction of traversal of the threshold that triggers an alert, an order of the destinations, and any time limitations on the alert. The contact information identifies designated location 270 and the method for contacting location 270 when an issuing an alert. The contact information can include, for example, a telephone number, a pager number, or IP address and port.

The destination list can be maintained in service center 240 or rover 210 or a combination of the two. However, keeping and manipulating the destination list at service center 240 has advantages. For example, a central dispatcher through terminal 160 and data connection 150 can organize destinations into an ordered destination list and download the list to service center 240. Since service center 240 is ideally Internet based, multiple people could access and manage the destination list via the Internet 150, even after rovers 210 have started their routes. End customers, who are anticipating a delivery, could also be given limited access to their destination entry to determine an estimated arrival time, schedule an alert immediately before arrival at their address, or change the contact information. Besides a web interface, the service center can also provide a telephone or e-mail interface for creating, changing, or reviewing a destination list.

Each destination entry is at least partially downloaded to rover 210, so that rover 210 at least has the destination and threshold information for the next destination. The destination location can be latitude and longitude (probably from geocoding the street address) as used in the GPS receiver. Generally, when service center 240 keeps the destination list, rover 210 does not require the contact information, but other information may be useful in rover 210. For example, text sent to rover 210 could indicate any information related to the destination, for example, a destination name and address that permits a driver/operator to more readily identify destinations when scrolling through the destination list. An appointment time associated with a destination provides the driver additional information for scheduling of deliveries.

Additional fields used by control circuit 214 in the communications package can indicate whether to generate an alert when the rover 210 crosses into the alert area, out of the alert area, or both. Generally, an alert is generated when rover 210 moves into the alert area to indicate an impending arrival. However, an alert can also be generated when rover 210 leaves an alert area indicating rover 210 is headed elsewhere, for example, possibly indicating that rover 210 is outside its intended range and may have been stolen or misdirected. Other information that can be included with a destination entry indicates an expiration time (when the entry is automatically deleted whether or not one or more alerts were generated), whether the entry should auto-delete after an alert is sent or is retained until its expiration time, and alternate contact information that may be indexed for use at different times.

In step 320, when rover 210 begins heading to the next destination, the operator/driver of rover 210 selects that destination for use in generating alerts. In particular, some alerts may only be issued if the alert is for the next destination. Other alerts could be issued regardless of the next destination. Optionally, the rover informs service center 240 of the selection. The selection of the destination can be automatic according to the order in the destination list or subject to the choice and judgement of the driver. If the list is downloaded to the rover 210 instead of being managed exclusively at service center 240, the in-vehicle system can display candidate destinations for the driver's selection. In some cases, the driver may override the order of destinations in the destination list because of traffic or other reasons not anticipated by the list's creators. Where the driver overrides the order, the rover 210 can send a message directing the service center to update the destination list to reflect the new order and update estimates of delivery times. The driver could even create new entries, although the limits of the user interface available on an in-vehicle system might make this difficult.

After rover 210 forwards or confirms the next destination, service center 240 in step 330 confirms the next destination and instructs the rover 210 to keep checking the location until rover 210 an alert condition is met, e.g., the rover enters an alert area for the selected destination. If necessary, service center 240 supplies a location for the selected destination and the alert conditions during step 330, but that information may have been previously downloaded into rover 210. In step 340, rover 210 determines whether rover 210 has crossed the boundary of the alert area. The appendix includes functions that record route hysteresis to determine whether a boundary has been crossed and whether the crossing direction is into or out of to the area within the boundary. In particular, if the alert condition indicates a bounding radius and a direction into the bounded area, the rover determines whether the rover has crossed from a distance from the destination that is greater than the bounding radius to a distance from the destination that is less than the threshold radius. Other more complicated threshold area descriptions could also be used. For example, the alert condition could identify an alert area other than a circle or include some variations based on the current or recent average speed of rover, but such identifications could significantly complicate the required calculations in rover 210.

A decision step 350 determines whether rover 210 reached the threshold for an alert. If not, rover 210, typically after a delay, again determines whether it has reached the threshold for an alert. In step 350, when rover 210 determines that it has crossed the threshold in the target direction, rover 210 in step 360 sends an alert to service center 240. In step 370, service center 240 forwards the alert to designated location 270 using the contact information from the destination list. The designated location 270 can be the destination or to another location. For example, if the destination is a customer's home and the designated location 270 is the customer's work address, the customer upon receiving the alert can return home to accept the delivery. As noted above, the designated location 270 can change according to factors such as the time.

In system 200 of FIG. 2, service center 240 activates alerting device 250 to send the alert to designated location 270. Alerting device 250 is a communication device such as an automated telephone messaging system or an automated e-mail system. The alerted party can be alerted in a variety of ways, including but not limited to by e-mail, paging message, text message to a cellular phone, or a telephone call with a synthesized speech or recorded message.

Method 300 can be widely varied without departing from the scope of the invention. For example, instead of providing service center 240 with a destination list, rovers 210 can keep their own destination lists. When the operator/driver of a rover 210 selects the next destination in step 320, the communications device in the rover accesses threshold and contact information in the stored on board in the destination list. In step 360, when rover 210 sends an alert to service center 240, the rover forwards the contact information for designated location 270, and service center 240 forwards the alert to the designated location 270.

In another variation of method 300, a rover 210 sends an alert whenever the rover is near particular destinations regardless of whether any of these destinations is the next destination. For this variation, the rover in step 340 compares the current location to the location and threshold information of all destinations that are eligible for alerts, and in step 350 decides to issue an alert if conditions for the alert are met. For example, a rover can issue an alert if the rover leaves a designate area or range from its base location (indicating perhaps that the rover is misdirected or stolen). Each destination entry can include a tag number that identifies the destination, and the rover 210 incorporates the tag number in the alert message sent to service center 240. From the tag number, service center 240 decides where (e.g., which designated location) and how to send the alert.

In some cases, the alerted party might be the truck dispatcher (for example, to alert the dispatcher that a truck is returning to base or that the truck has crossed a perimeter, heading away, and might be stolen). Service center 240 can forward an alert from a rover 210 to multiple designated locations, for example, to a customer, and to the dispatcher to alert the dispatcher as to the progress of their drivers.

Arrival alerting systems such as described above can be employed in a variety of applications. In warehousing, an alert indicating an impending arrival allows a delivery manager to deploy resources to a particular loading bay, and even to call ahead to the driver tell them which bay has been allocated for the delivery. In construction, when a supply truck is about to arrive, the site manager can ready loading/unloading equipment and people, to minimize turn-around time. Similarly, if a truck is delayed, resources are not wasted waiting for arrival, and time is not consumed periodically polling the position of the truck.

For consumer delivery, the alert can go to a location other than the destination, for example, to alert a consumer at work or via the consumer's pager that an impending delivery is destined for the consumer's home. If the consumer is near enough to home, the consumer can return home to meet the delivery or ask the delivery driver to wait. Another consumer application is automated activation of household equipment such as heating or cooling systems or appliances when the resident nears home. Energy can be saved by leaving heating and cooling systems in a low power mode while the resident is away and activating the system so that the home is at a comfortable temperature when the resident arrives. Alternatively, an alert can activate a coffeepot so that the resident has freshly brewed coffee when arriving home. The full range of applications of the invention is of course not limited to these few examples.

Although the invention has been described with reference to particular embodiments, the description is only an example of the invention's application and should not be taken as a limitation. For example, although the above embodiments employ GPS devices to identify locations, other locating systems using, for example, triangulation based on terrestrial signals or landmarks are also suitable for use in the embodiments described above. Various other adaptations and combinations of features of the embodiments disclosed are within the scope of the invention as defined by the following claims.

I claim:

1. An alert generating method, comprising:

providing a server on a wide area network accessible by a user to specify conditions for an alert and an action to be carried out when the conditions for the alert are met, the conditions referencing a position of a mobile unit;

providing to the mobile unit over a wireless network service connection the conditions for the alert, the wireless network service connection linking the mobile unit and a service center over the wide area network;

monitoring in the mobile unit the mobile unit's position;

providing the service center a signal indicating that the conditions for the alert are satisfied; and alerting a designated location by carrying out the specified action from the service center upon receiving the signal.

2. The method of claim 1, wherein the signal from the mobile unit is sent via the wireless network service connection.

3. The method of claim 1, wherein the specified action comprises telephoning the designated location.

4. The method of claim 1, wherein the specified action comprises sending e-mail to the designated location.

5. The method of claim 1, wherein providing the conditions for the alert comprises downloading information from the service center to the mobile unit.

6. The method of claim 5, further comprising downloading a destination list, including information that identifies the conditions for the alert, to the mobile unit from a web site corresponding to the service center.

7. The method of claim 1, wherein the conditions identify an area around a destination for the mobile unit.

8. The method of claim 7, wherein the conditions indicate that the alert should be generated when the mobile unit enters the area around the destination.

9. The method of claim 7, wherein the conditions indicate that the alert should be generated when the mobile unit leaves the area around the destination.

10. The method of claim 7, wherein the area around the destination is provided to the mobile unit as a location and a threshold radius that respectively correspond to a center and a radius of the area surrounding the destination.

11. The method of claim 1, further comprising selecting a destination for the mobile unit, wherein the conditions for the alert require that the selected destination be a destination that is identified in the conditions.

12. The method of claim 11, wherein an operator of the mobile unit selects the selected destination when the mobile unit is proceeding directly to the selected destination.

13. A delivery method comprising:

creating a list of destinations for deliveries at a service center, the list including a threshold distance for one or more destinations for which an alert should be generated;

providing a mechanism accessible over a wide area network for users related to the destinations to specify actions to be carried out when the alert is generated;

downloading a portion of the list of destinations to a mobile unit installed in a delivery vehicle, the downloading being effectuated over a wireless network connection which links the mobile unit to the service center over a wide area network;

selecting a destination from the list as a next destination for a delivery vehicle;

monitoring distance between the delivery vehicle and the selected destination;

generating the alert from the delivery vehicle when the distance is less than a threshold distance;

receiving the alert at the service center; and carrying out the specified action from the service center to the selected destination in response to the alert received at the service center.

14. The method of claim 13, wherein comprises sending a message from the delivery vehicle to the service center, the message including a tag identifying the destination.

15. A mobile unit comprising:

a location system;

a wireless device linking the mobile unit with a service center over a wireless network connection of a wide area network; and a control circuit including a user interface, wherein (1) the control circuit receives a destination list from the service center over the wireless connection, (2) the user interface allows a user to edit the destination list received and to select a current destination from the destination list, and (3) the control circuit sends a message to inform the service center of the current destination, automatically activates the location system to determine a current location of the mobile unit, determines whether the mobile unit has crossed a threshold relating to the current destination, and activates the wireless device to send an alert signal if the mobile unit has crossed the threshold.

16. The mobile unit of claim 15, wherein the location system is a GPS receiver.

17. The mobile unit of claim 15, wherein the wireless device is a wireless modem.

18. The mobile unit of claim 15, wherein the wireless device is an attached data-capable cellular telephone.

19. The mobile unit of claim 15, wherein the control circuit determines whether the mobile unit has crossed the threshold by determining whether the current location of the mobile unit is within an alert area.

20. The mobile unit of claim 19, wherein the control circuit calculates a distance between the current location and a central point in the alert area and determines whether the distance is less than a threshold distance associated with the alert area.

21. A system comprising:

a data connection to a wide area network;

an alerting device; and a service center connected to the data connection to enable receipt of messages from a mobile unit over a wireless network connection and connected to the alerting device to enable the service center to activate the alerting device and send alerts, the service center maintaining contact information for the mobile unit, wherein the service center comprises a server that permits access to the service center over the wide area network for setting the designated location to which the alerting device sends the alert and the conditions for the alert; and wherein in response to a signal from the mobile unit, the service center activates the alerting device to send an alert to a designated location identified in the contact information.

22. The system of claim 21, wherein the wide area network includes the internet, and wherein the server is accessed by a web browser.

* * * * *